US011380255B2

(12) United States Patent
Zhang et al.

(10) Patent No.: US 11,380,255 B2
(45) Date of Patent: Jul. 5, 2022

(54) OPTICAL COMPENSATION METHOD AND DEVICE, DISPLAY DEVICE, DISPLAY METHOD AND STORAGE MEDIUM

(71) Applicants: ORDOS YUANSHENG OPTOELECTRONICS CO., LTD., Ordos (CN); BOE TECHNOLOGY GROUP CO., LTD., Beijing (CN)

(72) Inventors: Chang Zhang, Beijing (CN); Tairong Kim, Beijing (CN); Shanfu Jiang, Beijing (CN)

(73) Assignees: ORDOS YUANSHENG OPTOELECTRONICS CO., LTD., Ordos (CN); BOE TECHNOLOGY GROUP CO., LTD., Beijing (CN)

( * ) Notice: Subject to any disclaimer, the term of this patent is extended or adjusted under 35 U.S.C. 154(b) by 471 days.

(21) Appl. No.: 16/474,398

(22) PCT Filed: Dec. 7, 2018

(86) PCT No.: PCT/CN2018/119765
§ 371 (c)(1),
(2) Date: Jun. 27, 2019

(87) PCT Pub. No.: WO2019/210687
PCT Pub. Date: Nov. 7, 2019

(65) Prior Publication Data

US 2021/0358406 A1 Nov. 18, 2021

(30) Foreign Application Priority Data

May 2, 2018 (CN) ..... 201810410742.X

(51) Int. Cl.
*G09G 3/3233* (2016.01)

(52) U.S. Cl.
CPC ... *G09G 3/3233* (2013.01); *G09G 2320/0233* (2013.01); *G09G 2320/0257* (2013.01);
(Continued)

(58) Field of Classification Search
None
See application file for complete search history.

(56) References Cited

U.S. PATENT DOCUMENTS 8,797,346 B2 8/2014 Park et al.
2003/0117414 A1* 6/2003 Sasaki ..... G09G 3/006 345/589
(Continued)

FOREIGN PATENT DOCUMENTS

CN 101419783 A 4/2009
CN 104934015 A 9/2015
(Continued)

OTHER PUBLICATIONS

International Search Report and Written Opinion in corresponding International Patent Application No. PCT/CN2018/119765 dated Feb. 27, 2019 (an English translation attached hereto). 16 pages.
(Continued)

*Primary Examiner* — Dorothy Harris
(74) *Attorney, Agent, or Firm* — Leason Ellis LLP

(57) ABSTRACT

An optical compensation method for a display panel, an optical compensation device for a display panel, a display method for a display panel, a display device, and a storage medium are disclosed. The optical compensation method for a display panel includes: acquiring a pre-stored compensation parameter of the display panel; acquiring a current brightness level of the display panel; adjusting the pre-stored compensation parameter based on the current brightness level to obtain an adjusted compensation parameter; and
(Continued)

compensating a display data signal of the display panel based on the adjusted compensation parameter.

17 Claims, 6 Drawing Sheets

(52) U.S. Cl.
CPC ..... *G09G 2320/0276* (2013.01); *G09G 2360/145* (2013.01); *G09G 2360/16* (2013.01)

(56) References Cited

U.S. PATENT DOCUMENTS

2006/0285025 A1* 12/2006 Yoshida ..... H04N 9/3194 349/8
2009/0096740 A1 4/2009 Xia et al.
2013/0016119 A1* 1/2013 Ukawa ..... G09G 5/005 345/589
2013/0328755 A1* 12/2013 Al-Dahle ..... G09G 3/3677 345/87
2016/0351139 A1* 12/2016 Syu ..... G09G 3/36

FOREIGN PATENT DOCUMENTS

CN 105895007 A 8/2016
CN 106847175 A 6/2017
CN 107958651 A 4/2018
KR 20150078029 A 7/2015

OTHER PUBLICATIONS

Extended European Search Report issued by the European Patent Office for the corresponding European Patent Application No. 18889954.6, dated Dec. 20, 2021. 10 pages.

* cited by examiner

OPTICAL COMPENSATION METHOD AND DEVICE, DISPLAY DEVICE, DISPLAY METHOD AND STORAGE MEDIUM

CROSS REFERENCE TO RELATED APPLICATIONS

This application is a U.S. National Stage Application under 35 U.S.C. § 371 of International Patent Application No. PCT/CN2018/119765, filed Dec. 7, 2018, which claims priority to Chinese Patent Application No. 201810410742.X, filed May 2, 2018, both of which are incorporated by reference in their entireties as part of the present application.

TECHNICAL FIELD

The embodiments of the present disclosure relate to an optical compensation method and an optical compensation device for a display panel, a display method for a display panel, a display device, and a storage medium.

BACKGROUND

Organic light-emitting diode (OLED) display devices have many advantages such as high contrast, ultra-thinness, and flexibility compared to liquid crystal displays (LCDs), and therefore have been increasingly used in high performance displays. However, brightness uniformity and after-image are two major challenges which OLED displays are facing today. In order to solve the technical problems of OLED displays regarding brightness uniformity and after-images, in addition to the improvements of manufacturing processes, compensation techniques have also been proposed.

SUMMARY

At least one embodiment of the present disclosure provides an optical compensation method for a display panel, including: obtaining a pre-stored compensation parameter of the display panel; obtaining a current brightness level of the display panel; adjusting the pre-stored compensation parameter based on the current brightness level to obtain an adjusted compensation parameter; and compensating a display data signal of the display panel based on the adjusted compensation parameter.

For example, in an optical compensation method for a display panel provided by an embodiment of the present disclosure, an adjustment amplitude for adjusting the pre-stored compensation parameter decreases as the current brightness level increases.

For example, in an optical compensation method for a display panel provided by an embodiment of the present disclosure, a calculation formula for compensating the display data signal of the display panel based on the adjusted compensation parameter is expressed as:

$$Y=aX+b2,$$

where Y represents a compensated pixel voltage, X represents an initial pixel voltage of the display panel, a represents a first optical compensation parameter, and b2 represents an adjusted compensation parameter and is determined based on the current brightness level of the display panel.

For example, in an optical compensation method for a display panel provided by an embodiment of the present disclosure, the adjusted compensation parameter is expressed as:

$$b2=b1*c$$

where b1 represents a second optical compensation parameter, c represents an offset-scalar and is determined based on the current brightness level of the display panel.

For example, in an optical compensation method for a display panel provided by an embodiment of the present disclosure, predetermined offset-scalars corresponding to different brightness levels of the display panel are stored in the lookup table correspondingly with the different brightness levels of the display panel, the optical compensation method further including: obtaining, from the lookup table, an offset-scalar corresponding to the current brightness level.

For example, in an optical compensation method for a display panel provided by an embodiment of the present disclosure, the range of variation of the offset-scalar varies between 0.5 times and 5 times.

For example, an optical compensation method for a display panel provided by an embodiment of the present disclosure further including: determining whether the current brightness level of the display panel is lower than a threshold brightness; adjusting the pre-stored compensation parameter based on the current brightness level in a case where the current brightness level of the display panel is lower than the threshold brightness; and in the case where the current brightness level of the display panel is not lower than the threshold brightness, not adjusting.

For example, in an optical compensation method for a display panel provided by an embodiment of the present disclosure, the display panel includes a plurality of display areas, the pre-stored compensation parameter, the current brightness level, and the adjusted compensation parameter correspond to at least one display area, and the display data signal of the at least one display area is compensated based on the adjusted compensation parameter.

For example, an optical compensation method for a display panel provided by an embodiment of the present disclosure further including: obtaining an adjusted compensation parameter of each of the plurality of display areas respectively; and compensating the display data signal of each of the plurality of display areas respectively.

For example, an optical compensation method for a display panel provided by an embodiment of the present disclosure further including: determining whether the brightness of the display panel has been instructed to change; acquiring a brightness level, which the display panel is currently instructed to present, as the current brightness level in a case where the brightness of the display panel has been instructed to change; adjusting the pre-stored compensation parameter based on the current brightness level to obtain the adjusted compensation parameter.

For example, at least one embodiment of the present disclosure further provides a display method for a display panel, including: compensating the display data signal of the display panel by using an optical compensation method provided by any embodiment of the present disclosure; and performing a display operation using the compensated display data signal.

At least one embodiment of the present disclosure further provides an optical compensation device for a display panel, including: a compensation parameter acquisition circuit, which is configured to acquire a pre-stored compensation parameter of the display panel; a brightness level acquisition circuit, which is configured to acquire a current brightness level of the display panel; a compensation parameter adjustment circuit, which is configured to adjust the pre-stored compensation parameter based on the current brightness level to obtain an adjusted compensation parameter; and a compensation circuit, which is configured to compensate the display data signal of the display panel based on the adjusted compensation parameter.

At least one embodiment of the present disclosure further provides an optical compensation device for a display panel, including: a processor; a memory, non-transitorily storing at least one computer program module, the at least one computer program module is configured to be executed by the processor, the at least one computer program module including instructions for performing an optical compensation method for a display panel provided by any of the embodiments of the present disclosure.

At least one embodiment of the present disclosure further provides a display device including an optical compensation device for a display panel provided by any embodiment of the present disclosure.

At least one embodiment of the present disclosure further provides a storage medium, non-transitory storing computer readable instructions; the non-transitory computer readable instructions, when executed by a computer, implement an optical compensation method for a display panel provided by any embodiment of the present disclosure.

BRIEF DESCRIPTION OF THE DRAWINGS

In order to more clearly explain the technical solutions of the embodiments of the present disclosure, in the following the drawings of the embodiments will be briefly introduce. Obviously, the drawings in the following description only relate to some embodiments of the present disclosure, and are not intended to limit the disclosure.

FIG. 1 is a schematic diagram of an external optical compensation system;

DETAILED DESCRIPTION

Figure 1:
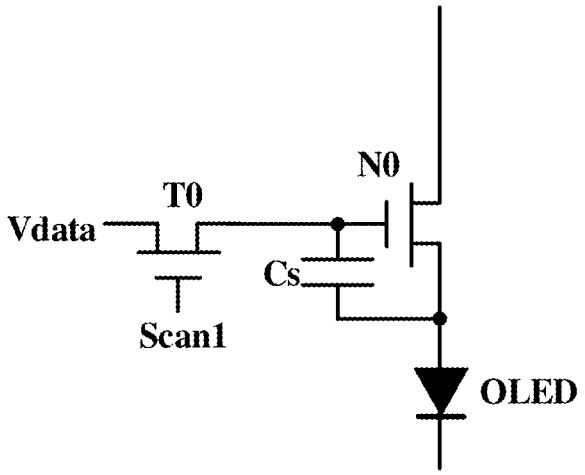
FIG. 1 is a schematic diagram of a 2T1C pixel circuit.

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, various embodiments in accordance with the present disclosure will be described in detail with reference to the accompanying drawings. It is to be noted that in the drawings, the same reference numerals are given to the components having substantially the same or similar structures and functions, and the repeated description thereof will be omitted.

Typically, organic light emitting diode (OLED) display panels include AMOLED display panels and PMOLED display panels. OLED display panels are widely used in different fields; in the field of commercials, OLED display panels can be applied to POS machines and ATM machines, copying machines, game machines, etc.; in the field of communication, OLED display panels can be applied to mobile phones, mobile network terminals, etc.; in the field of computers, OLED display panels can be applied to PDA (Personal Digital Assistant, Pocket PC), commercial PC (personal computer), and home PC, notebook computer, etc.; in the field of consumer electronics, OLED display panels can be applied to audio equipment, digital cameras, portable DVD (Digital Video Disc), etc.; in the field of industrial, OLED display panels can be applied to instrumentations or the like; in the field of transportation, OLED display panels can be applied to GPS (Global Positioning System), aircraft instrumentation, etc.

A basic pixel circuit used in an AMOLED display device is usually a 2T1C pixel circuit, which realizes a basic function of driving OLED to emit light by using two thin film transistors (TFTs) and a storage capacitor Cs. As shown in FIG. 1, the 2T1C pixel circuit includes a switching transistor T0, a driving transistor N0, and a storage capacitor Cs, for driving an OLED in a corresponding pixel unit. The switching transistor T0 is turned on/off by a scan signal, thereby charging the storage capacitor Cs to the voltage corresponding to the display data, controlling the conduction degree of the driving transistor N0 by the data voltage stored by the storage capacitor Cs, and controlling the current flowing through an OLED and adjusting the brightness of the OLED.

Low-temperature polysilicon thin film transistors (LTPS TFTs) are often used in small and medium-sized OLED display panels, and oxide thin film transistors are often used in large-sized OLED display panels. This is because LTPS TFTs have a higher mobility and a smaller transistor area, which is more suitable for high PPI (Pixels Per Inch). Oxide thin film transistors have better uniformity, the process of the oxide thin film transistors are compatible with general amorphous silicon thin film transistors (a-Si TFT), and the oxide thin film transistors are more suitable for production on a production line.

For the OLED pixel circuits used in a small and medium size display panel, due to the limitations of the crystallization process of forming a polysilicon active layer of a TFT, LTPS TFTs at different positions often have non-uniformity in electrical parameters such as threshold voltage, mobility, and the like. This non-uniformity result in current and brightness differences in the OLED display panels and is perceived by human eyes (i.e., the Mura phenomenon). For the OLED pixel circuits used in a large-size display panel, although the uniformity of the process of oxide thin film transistors is good, the threshold voltages of the oxide thin film transistors may drift under long-time high voltage and high temperature. Due to the difference in display images, the threshold shift amounts of the TFTs in different parts of the panel are different, which causes a fluctuation in display brightness. This difference is related to the previously displayed images, and therefore often appears as an afterimage phenomenon, also known as afterimage.

In the current fabrication processes, both LTPS TFTs and oxide (for example, IGZO) thin film transistors have problems of uniformity or stability. Moreover, an OLED itself will gradually decay with the increase of the lighting time. These problems are difficult to completely overcome in the process, and must be solved by various compensation techniques.

At present, technical problems of brightness uniformity and afterimage of an OLED display panel can be solved by an internal compensation technique or an external compensation technique. The internal compensation technique refers to a method of performing compensation inside a pixel by using a compensating sub-circuit formed by a TFT(s). The external compensation technique refers to a method of sensing the electrical or optical characteristics of a pixel through an external drive circuit or device and then performing compensation. Due to the complicated design and high process difficulty of AMOLED circuits, in the case of realizing a high-resolution (QHD or above) display, if the display panel is internally compensated, it will be difficult to eliminate the Mura phenomenon of the display screen. Therefore, in order to improve product yield, reduce the occurrence of the Mura phenomenon and enhance the comprehensive competitiveness of products in the market, on the basis of internal compensation, external compensation is used to improve product completion and product yield.

Figure 2:
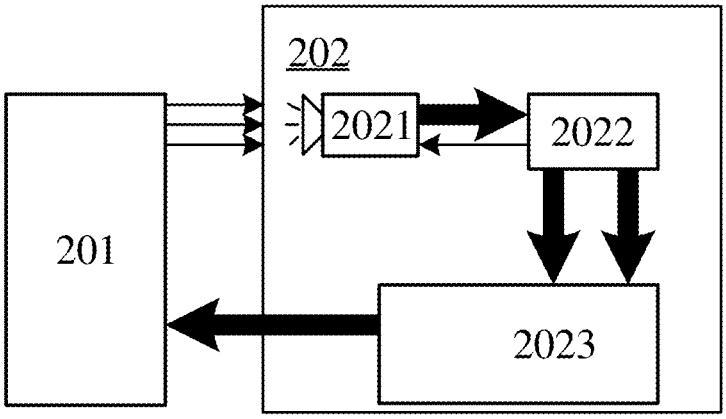

FIG. 2 shows a schematic diagram of an external optical compensation (Demura) system. As shown in FIG. 2, the optical compensation system includes an OLED display panel 201 under testing and an optical compensation device 202. The optical compensation device 202 includes a camera 2021, a data processing unit 2022, a control unit 2023, and the like, which are in a wired connection or a wireless signal connection with each other.

For example, some embodiments of the present disclosure are described by taking an OLED display panel as an example. The OLED display panel may include, in addition to a pixel array, a data decoding circuit, a timing controller (T-con), a gate drive circuit, a data drive circuit, and a storage device (such as a flash memory or the like). The data decoding circuit receives a display input signal and decodes the display input signal to obtain a display data signal; the timing controller outputs a timing signal to control the synchronous operation among the gate drive circuit, the data drive circuit, etc., and the timing controller can perform gamma correction on the display data signal and output the processed display data signal to the data drive circuit for display operation. For example, the timing controller may further perform compensation processing on the display data signal before performing gamma correction, for example, reading out a pre-stored pixel compensation parameter from the storage device, and further processing the display data signal by using the pixel compensation parameter to obtain the compensated display data signal, and after the completion of the compensation processing and the gamma correction, the display data signal is output to the data drive circuit for display operation. Alternatively, the display panel may include an independent gamma circuit, and this gamma circuit performs gamma correction, compensation processing and the like on the display data signal under the control of the timing controller.

For example, in at least one example, the optical compensation device 202 can include a processor and a memory configured to store computer program instructions adapted to be loaded by a processor to perform an optical compensation method for a display panel (which will be described in detail later) and to implement the functions of the various functional modules (for example, data processing unit 2022 and control unit 2023) as illustrated in FIG. 2. The processor can be of various applicable processors, for example, can be implemented as a central processing unit, a microprocessor or an embedded processor, and can adopt an architecture such as X86 or ARM. The memory can be any suitable storage device, such as a non-volatile storage device, including but not limited to magnetic storage devices, semiconductor storage devices, and optical storage devices, and can be configured as a single storage device, a storage device array, or a distributed storage device. The embodiments of the present disclosure are not limited in these aspects.

The data processing unit 2022 of the optical compensation device 202 sends a test image to the control unit 2023, and the control unit 2023 processes the test image and then sends the test image to the OLED display panel 201 under testing to display the required picture for testing. In addition, the data processing unit 2022 further obtains a captured image of the actually displayed picture of the OLED display panel from the camera 2021, and compares the captured image with the test image to obtain the pixel compensation parameter. The pixel compensation parameter is input into the storage device of the OLED display panel 201 for storage, for the OLED display panel to perform compensation processing during the subsequent display operation.

For example, the camera 2021 is configured to capture brightness information of each pixel, at a selected grayscale, of the OLED display panel 201 under testing. For example, the camera 2021 is, for example, a high resolution, high precision CCD camera. It should be noted that the camera 2021 includes, but is not limited to, a CCD (Charge Coupled Device) camera or a CMOS (Complementary Metal Oxide Semiconductor) camera.

For example, in at least one example of some embodiments of the present disclosure, in order to obtain the pixel compensation parameter, the data processing unit 2022 is configured to perform process to obtain a measured gray-scale response curve of each of the pixels, and then finally obtain polynomial coefficients for compensation according to an ideal gray-scale response curve, by a method of adjusting the gray-scale such as performing curve fitting of compensated gray-scale and input gray-scale by using polynomial. The polynomial coefficients for compensation are written in the storage device of the display panel 201 under the control of the control unit 2023.

After that, when the OLED display panel 201 is used as a product during normal display operation, the control unit (for example, the timing controller T-con) in the display panel 201 reads these pre-stored polynomial coefficients for pixel compensation from storage device of the control unit, and performs process to obtain the corrected gray-scale for the gray-scale of each pixel, realizing real-time compensation for the gray-scale accuracy of each pixel, achieving uniformity of brightness, and finally improving the display uniformity of the OLED display panel 201 as a whole. For example, the polynomial of the optical compensation algorithm can be expressed as:

$$Y=aX+b1 \quad (1)$$

where Y represents a compensated pixel voltage, X represents an initial pixel voltage of the display panel, a represents a gain, and b1 represents an offset.

For example, a and b1 in the above formula (1) are coefficients of the polynomial. Similarly, gray-scale uniformity compensation can be performed on each pixel of the OLED display panel. The gray-scale compensation is taken as an example for the following description, but the embodiments of the present disclosure are not limited to this aspect.

The difficulties or disadvantages of the above optical compensation method are: because the change amplitude of the Mura becomes larger as the display brightness level of the display panel becomes lower, and the change amplitude is non-linear, the brightness corresponding to the gray-scales of the sub-pixels change to different degrees. The optical compensation method described above cannot recognize the changes in the brightness of the gray-scales of the sub-pixels caused by the changes in the brightness control of the display panel (i.e., brightness level), that is to say, the changes in the final pixel voltages, resulting in an unsatisfactory compensation effect.

Figure 3:
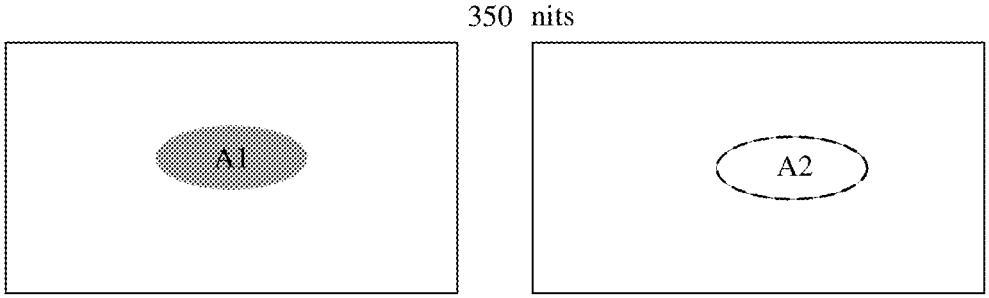
FIG. 3 is a schematic diagram showing the simulation of an optical compensation effect in a brightness interval.

For example, FIG. 3 is a schematic diagram showing the simulation of the optical compensation effect when the display brightness is 350 nits. For example, a brightness unevenness area A1 in the image on the left is the area to be compensated, and an area A2 in the image on the right side is the compensated image by the above optical compensation method. As shown in FIG. 3, when the display brightness is 350 nits, the optical compensation method described above can compensate the pixel voltage in the area A1 so as to match the display effect of the surrounding areas (for example, the area A2).

Figure 4:
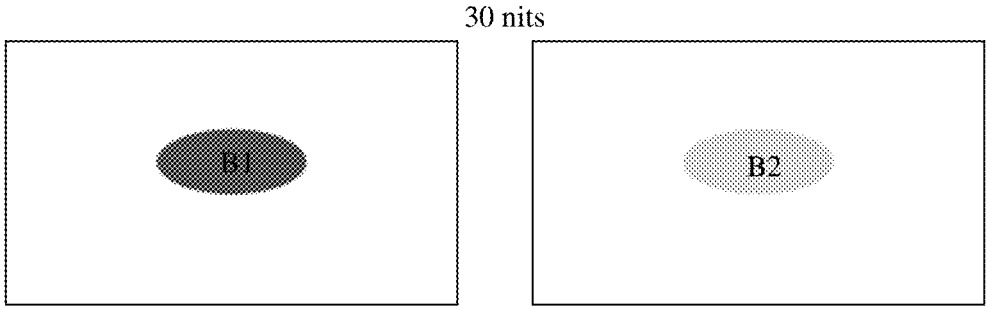
FIG. 4 is a schematic diagram showing the simulation of an optical compensation effect in another brightness interval.

FIG. 4 is a schematic diagram showing the simulation of the optical compensation effect when the display brightness is 30 nits. As shown in FIG. 4, the display brightness is reduced from 350 nits shown in FIG. 3 to 30 nits, and at this time, because the change amplitude of Mura is larger as the brightness level (i.e., display brightness) of the display panel is lower, the pixel voltage required to be compensated in the brightness unevenness area B1 as shown in FIG. 4 (the same position as the uneven area A1 in FIG. 3) is changed, that is, different from the pixel voltage required to be compensated in the area A1 as shown in FIG. 3. At this time, if the optical compensation parameter in the optical compensation method under the display brightness as shown in FIG. 3 is further used for compensation, that is, the pixel compensation voltage used for FIG. 3 is also applied to the area B1 as shown in FIG. 4, the display area B1 (i.e., the area B2 as shown in FIG. 4) is still inconsistent with the display effect of the surrounding area, so that the compensation effect is not desirable over the entire display brightness range.

An embodiment of the present disclosure provides an optical compensation method for a display panel, including: obtaining a pre-stored compensation parameter of the display panel; obtaining a current brightness level of the display panel; adjusting the pre-stored compensation parameter based on the current brightness level to obtain an adjusted compensation parameter; and compensating a display data signal of the display panel based on the adjusted compensation parameter.

At least one embodiment of the present disclosure further provides an optical compensation device for a display panel, a display method for a display panel, a display device, and a storage medium.

The optical compensation method for a display panel of some embodiments of the present disclosure can be linked with a brightness control, and can dynamically adjust the compensation parameter of the compensation polynomial at different display brightness levels. Therefore, the problem that the change magnitude of Mura that is caused by, for example, the deviations of the driving TFTs in the pixel circuits becomes larger as the display brightness becomes lower can be well solved, and the compensation effect of the display panel is improved.

Hereinafter, embodiments of the present disclosure will be described in detail with reference to the accompanying drawings. It should be noted that the same reference numerals will be used in the different drawings to refer to the same elements that have been described.

Figure 5:
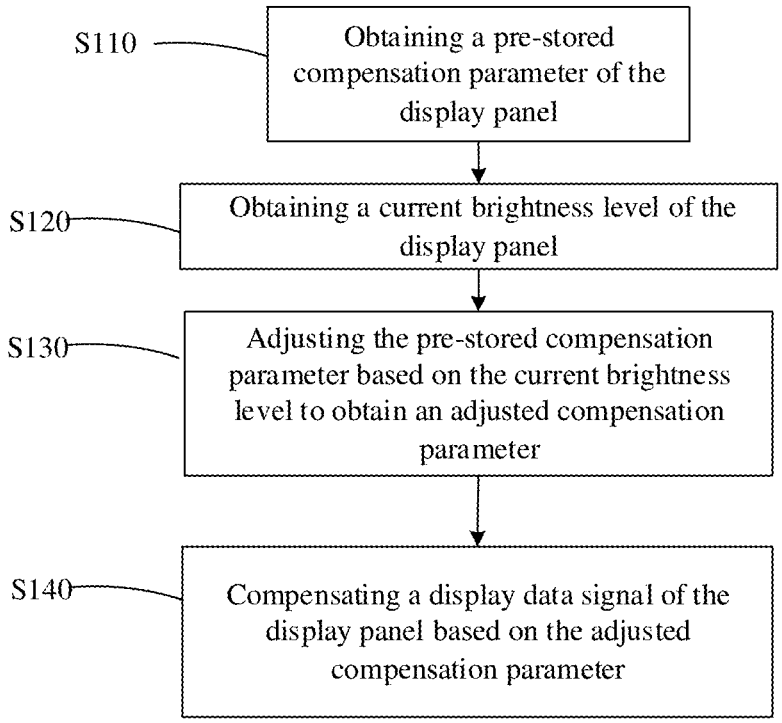
FIG. 5 is a flowchart of an optical compensation method for a display panel according to some embodiments of the present disclosure.

FIG. 5 is a flow chart of an example of an optical compensation method for, for example, an organic light emitting diode display panel, according to an embodiment of the present disclosure. For example, the optical compensation method can be loaded and executed by a processor in the display panel to solve the problem that the above-mentioned compensation effect is not satisfactory. For example, the compensation method as shown in FIG. 5 can be performed in real time in the display operation of the OLED display panel, so that the display data of the display panel can be compensated in real time, the display uniformity of the display panel is improved, and the display quality of the display panel is improved.

In the following, an optical compensation method of an embodiment of the present disclosure will be described with reference to FIG. 5. As shown in FIG. 5, the optical compensation method includes steps S110 to S140.

Step S110: obtaining a pre-stored compensation parameter of the display panel.

For example, the display panel is an OLED display panel. The display data of the display panel can be, for example, in 10 bytes or 8 bytes, thereby realizing different gray-scale quantities (8 bytes corresponding to 256 levels of gray, and 10 bytes corresponding to 1024 levels of gray), and correspondingly the gray-scale quantities can be used for realizing display of different kinds of colors. For example, the pre-stored compensation parameter(s) pre-stored in the display panel may be acquired by a dedicated compensation parameter acquisition circuit, or may be implemented by a central processing unit (CPU) or processing units of other forms having data processing capabilities and/or instruction execution capabilities. The processing unit may be a general purpose processor or a dedicated processor, and may be a processor based on an X86 or ARM architecture or the like. For example, the compensation parameter acquisition circuit is provided in a control device (controller) of the display panel.

For example, as described above, in the compensation parameter acquisition/setting process, the high-resolution, high-precision camera 2021 may be used to acquire the test image displayed by the OLED display panel 201, and the camera 2021 transmits the data of the test image to the data processing unit 2022 after the test image is captured. The data processing unit 2022 analyzes the gray-scale/brightness distribution feature of each pixel of the display panel according to the collected data of the test image, and identifies, according to a relevant algorithm, the gray-scale/brightness difference between each pixel in the display panel and a corresponding pixel in the target test image (that is, Mura), the related methods include, but are not limited to, optical measurement methods. Then, the compensation parameters of the display panel are calculated, according to the Mura data of each pixel of the display panel and the corresponding optical compensation algorithm. These compensation parameters are then stored for use during the normal display operation, and are therefore referred to as pre-stored compensation parameters. The optical compensation algorithm includes, but is not limited to, any known Demura compensation algorithm. For example, the pre-stored compensation parameters of the display panel include the gain a and the offset b1 in the above formula (1).

It should be noted that in the field of display, the brightness of a gray-scale is a certain level divided between black (no light) and white (highest brightness) for achieving color combination. For example, every point on a display panel that people see with the naked eyes, that is to say, one pixel, is composed of three sub-pixels of red, green, and blue (RGB). Each sub-pixel can exhibit different brightness levels. The red, green, and blue sub-pixels of different brightness levels are combined to form the point (i.e., pixels) of different colors. Gray-scale represents the hierarchy of the levels of different brightness from the darkest to the brightest. The more levels, the more delicate the picture will be presented. It can be seen that the color change of each point on the display panel is actually caused by the brightness change of the gray-scales of the three RGB sub-pixels constituting this point. The following embodiments are the same as those described herein and will not be described again.

For example, the display brightness of the display panel is the value when the brightness of the gray-scale of the display panel is totally white, that is, the highest brightness that the display panel can provide. For example, taking an LCD display panel as an example, the display brightness of the display panel is a backlight brightness emitted by a backlight, and the backlight brightness determines the display brightness of the display panel. Usually, the display brightness of the display panel is selected in relation to the viewing environment. In a very dark environment, such as in a movie theater, the brightness on the screen is 30-45 cd/m$^2$; if watching TV indoors, the brightness on the display screen is greater than 100 cd/m$^2$; if in a public place or in a strong ambient light, the display brightness of the display screen is, for example, 300-500 cd/m$^2$. The following embodiments are the same as those described herein and will not be described again.

For example, the pre-stored compensation parameters may be measured and calculated before the optical compensation operation. For example, the pre-stored compensation parameters may be measured and calculated before an OLED display panel is shipped from a manufactory, or may be measured and calculated after the OLED display panel is shipped from the manufactory. For example, the pre-stored compensation parameters are stored in a memory of the OLED display panel from which the OLED display panel can be read when needed. In addition to storing of the data for calculation and the data resulting from calculation, the memory can include one or more computer program products, which can include various forms of computer readable storage media, such as volatile memory and/or non-volatile memory.

Step S120: obtaining a current brightness level of the display panel.

For example, the current brightness level of the display panel (i.e., the current display brightness of the display panel) may be acquired by a dedicated brightness level acquisition circuit, or may be obtained by the central processing unit (CPU) described above or processing units of other forms having data processing capabilities and/or instruction execution capabilities. For example, the brightness level acquisition circuit is provided in a control device (controller) of the display panel. The brightness level acquisition circuit acquires the current brightness level of the display panel according to the brightness control signal output by the brightness control circuit of the current system, or acquires the current brightness level of the display panel from a storage device (for example, a register) that stores the current brightness level.

The current brightness level of the display panel can be changed as needed or changed in real time. Taking a smart phone as an example, when the brightness of the external environment is dim, the brightness of the mobile phone screen (display brightness) is automatically reduced to achieve a comfortable brightness for the human eyes; when the brightness of the external environment is bright, the brightness of the mobile phone screen is automatically raised to achieve a comfortable brightness for the human eyes. Therefore, the value of the current brightness level can be changed in real time as needed. Also taking virtual reality (VR) glasses as an example, because human eyes usually only pay attention to a gaze point, as needed, the brightness of an area of the display panel where the gaze point of human eyes is located can be relatively increased, and the brightness of the remaining area(s) of the display panel can be relatively reduced. The brightness control of the display panel can be implemented in various ways, and will not be described here.

Step S130: adjusting the pre-stored compensation parameter based on the current brightness level to obtain an adjusted compensation parameter.

For example, the adjusted compensation parameter is expressed as:

$$b2=b1*c \tag{2}$$

where b1 represents a second optical compensation parameter (i.e., offset), c represents an offset-scalar and c is determined based on the current brightness level of the display panel.

For example, the adjusted compensation parameter may be obtained by a dedicated compensation parameter adjustment circuit, or may be implemented by the above-described central processing unit (CPU) or processing units of other forms having data processing capabilities and/or instruction execution capabilities. For example, the compensation parameter adjustment circuit calculates the adjusted compensation parameter b2 by calling the second compensation parameter b1 and the offset-scalar c stored in the OLED display panel memory.

For example, the second optical compensation parameter b1 is one of the pre-stored compensation parameters, which can be obtained by step S110.

For example, the offset-scalar c can be stored by means of a lookup table. For example, predetermined offset-scalars corresponding to different brightness levels of the display panel are stored in the lookup table correspondingly with the corresponding brightness levels of the display panel; for example, predetermined brightness levels within different intervals correspond to different predetermined offset-scalars; these predetermined offset-scalars can be obtained, for example, by experiments, or by simulation, or obtaining the initial data through experiments and then obtaining the calculation rule by a fitting method. For example, the optical compensation method can further include obtaining, in the lookup table, an offset-scalar corresponding to the current brightness level, and then further obtaining an adjusted compensation parameter based on the located offset-scalar. For example, after obtaining the current brightness level of the display panel in step S120, the offset-scalar corresponding to the current brightness level may be queried in the lookup table, thereby obtaining the adjusted compensation parameter according to the offset-scalar. According to different current brightness levels, different offset-scalars can be obtained, and the pre-stored compensation parameters under different display brightness can be dynamically adjusted, thereby achieving the linkage with the brightness control, so that the problem that the change amplitude of the Mura, which is caused for example by the deviations of the driving TFTs in the pixel circuits, becomes larger as the display brightness becomes lower can be better solved.

For another example, based on the current brightness level of the display panel obtained in step S120, after the current brightness level is introduced into the control unit 2023 for example as shown in FIG. 2, the control unit 2023 can perform calculation in conjunction with the current brightness level of the display panel, the corresponding optical compensation algorithm, and the Mura data of each sub-pixel of the display panel (for example, gray-scale/brightness difference, etc.) to obtain the offset-scalar corresponding to the current brightness level of the display panel.

It should be noted that, as described above, the offset-scalar is not limited to being obtained by means of the looking-up table, and may also be obtained in real time by the above-described calculation manner, which is not limited by the embodiments of the present disclosure.

For example, the adjustment amplitude for adjusting the pre-stored compensation parameter decreases as the current brightness levels increases, i.e., the adjusted compensation parameter and the offset-scalar decrease as the current brightness level increases. Because the change amplitude of Mura becomes larger as the display brightness becomes lower, the value of the offset-scalar becomes larger correspondingly when the current brightness level becomes lower, so that the value of the adjusted compensation parameter is correspondingly larger, and the adjustment range for adjusting the pre-stored compensation parameter increases as the current brightness level decreases, thereby effectively solving the problem of Mura. In the same way, when the current brightness level becomes higher, the value of the offset-scalar becomes smaller correspondingly, so that the value of the adjusted compensation parameter is correspondingly smaller, so that the adjustment range of the pre-stored compensation parameter decreases as the current brightness level increases.

For example, the range of variation of the offset-scalar may vary between 0.5 times and 5 times according to the current brightness level, for example, the offset-scalar may take a value between 0.5 and 5. Embodiments of the present disclosure include, but are not limited thereto.

For example, in another example, the adjusted compensation parameter may also be expressed as:

$$b2=b1+c \tag{3}$$

It should be noted that the offset-scalar c employed by the above formula (3) is different from the offset-scalar c employed by the formula (2). The specific representation of the adjusted compensation parameter is determined according to the actual situations, and the embodiments of the present disclosure are not limited to this aspect.

For example, the lookup table, or the adjusted compensation parameter and the offset-scalar obtained in real time may be stored in a memory of the OLED display panel, and the controller may read from the memory when needed.

Step S140: compensating a display data signal of the display panel based on the adjusted compensation parameter.

For example, a calculation formula for compensating a display data signal of a display panel based on the adjusted compensation parameter is expressed as:

$$Y=aX+b2 \tag{4}$$

where Y represents a compensated pixel voltage, X represents an initial pixel voltage of the display panel, a represents a first optical compensation parameter (that is, a gain), and b2 represents an adjusted compensation parameter and b2 is determined based on the current brightness level of the display panel as described above.

For example, the display data signal of the display panel may be compensated by a dedicated compensation circuit, or may be implemented by the above-mentioned central processing unit (CPU) or processing units of other forms having data processing capabilities and/or instruction execution capabilities. For example, the compensation circuit obtains the compensated pixel voltage Y by calling the initial pixel voltage X of the display panel, the adjusted compensation parameter b2 obtained after calculation, and the first optical compensation parameter a stored in the OLED display panel memory. For example, under the control of a controller, the compensation circuit outputs the compensated pixel voltage Y (i.e., the display data signal) to the data drive circuit for display operation, thereby realizing compensation of the display image of the display panel.

For example, the adjusted compensation parameter b2 can be obtained by step S130, the first optical compensation parameter a as one of the pre-stored compensation parameters can be obtained by step S110, and the details are not described herein again. For example, the initial pixel voltage X of the display panel can be obtained by decoding the input image data signal for display by the image signal processing device of the display panel. For example, the initial pixel voltage X and the compensated pixel voltage Y may be gray-scale data signals.

In the embodiment of the present disclosure, the optical compensation method of the OLED display panel can be linked with the brightness control, and the optical compensation parameters under different display brightness can be dynamically adjusted. Therefore, the problem that the change amplitude of the Mura phenomenon, which is caused by the deviations of the driving TFTs in the pixel circuits, becomes larger as the display brightness becomes lower, can be well solved, and the compensation effect of the display panel is improved.

Figure 6:
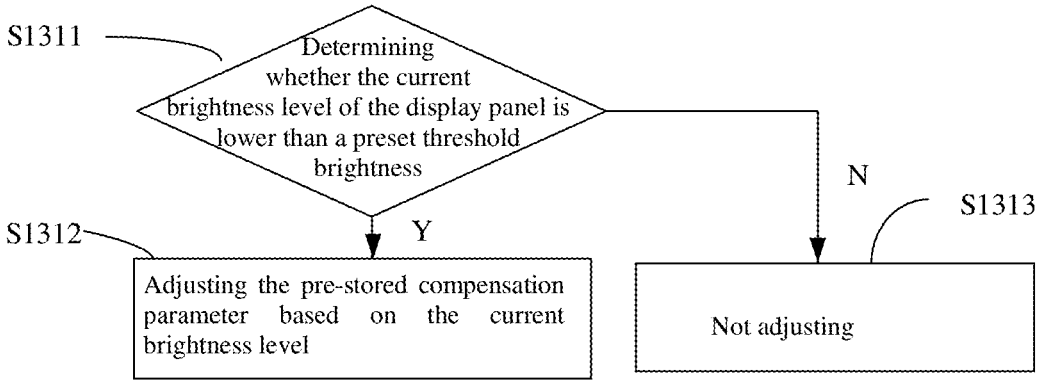
FIG. 6 is a flowchart of an example of an optical compensation method for a display panel according to some embodiments of the present disclosure.

FIG. 6 is a flow chart of another example of an optical compensation method of an organic light emitting diode display panel according to an embodiment of the present disclosure. That is, FIG. 6 is an operational flowchart of an example of step S130 as shown in FIG. 5. As shown in FIG. 6, the optical compensation method further includes steps S1311 to S1313. In the following, the optical compensation method of an embodiment of the present disclosure will be described with reference to FIG. 6.

Step S1311: determining whether the current brightness level of the display panel is lower than a preset threshold brightness, and if yes, executing step S1312; if not, executing step S1313.

For example, there are conducted the operation of analyzing the rule that the Mura of a general display panel (i.e., a non-specific display panel) changes with the brightness level of the display panel, and then determining the threshold brightness according to the rule, for example, the threshold brightness is the preset threshold brightness; for example, the preset threshold brightness is selected to be 85% of the maximum display brightness, and the like. The preset threshold brightness can be written to the memory of the display panel. For example, in the compensation process, when the current brightness level of the display panel is lower than the preset threshold brightness, the change magnitude of the Mura is relatively large, and when the current brightness level is higher than the preset threshold brightness, the change magnitude of the Mura is relatively small or even negligible (for example, there is no phenomenon that the compensation effect is poor).

For example, the preset threshold brightness may be stored in a memory of the OLED display panel, and the controller may read from the memory when needed.

Step S1312: adjusting the pre-stored compensation parameter based on the current brightness level.

For example, when the current brightness level is lower than the preset threshold brightness, the change magnitude of the Mura is large, thereby, the pre-stored compensation parameter is adjusted based on the current brightness level to obtain an adjusted compensation parameter so as to compensate the display data of the display panel.

Step S1313: Not performing adjustment.

For example, when the current brightness level is higher than the preset threshold brightness, the change amplitude of the Mura is relatively small, at this time, the pre-stored compensation parameters (for example, the first compensation parameter a and the second compensation parameter b1) can be used to compensate the display data of the display panel at the current brightness level, and there will be no poor compensation effect. Thereby, the calculation of adjusted compensation parameter is avoided, the calculation amount is reduced, the storage space of the display panel is saved, so that the system power consumption is reduced, and the running speed of the display device is improved.

Figure 7:
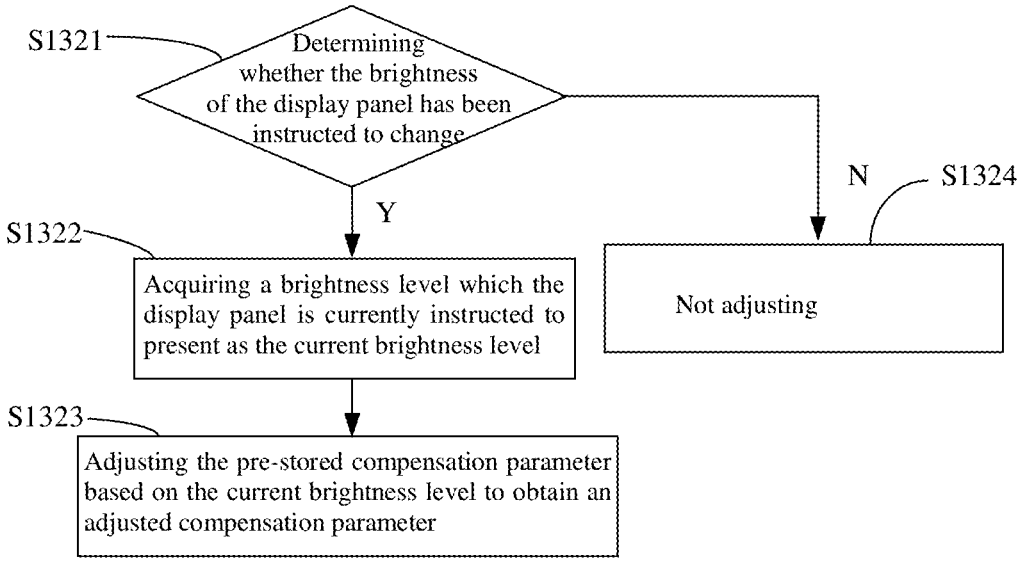
FIG. 7 is a flowchart of another example of an optical compensation method for a display panel according to some embodiments of the present disclosure.

FIG. 7 is a flow chart of another example of an optical compensation method for an organic light emitting diode display panel according to an embodiment of the present disclosure. That is to say, FIG. 7 is an operational flowchart of another example of step S130 as shown in FIG. 5. As shown in FIG. 7, the optical compensation method further includes steps S1321 to S1324 for performing the synchronization between the brightness control and the compensation operation, instead of the delayed compensation due to compensation based on the display brightness of the display picture that the display panel has been displayed (for example, the display brightness of the previous frame). In the following, an optical compensation method of an embodiment of the present disclosure will be described with reference to FIG. 7.

Step S1321: determining whether the brightness of the display panel has been instructed to change.

For example, the instruction is a system instruction. For example, a smartphone is taken as an example, and the system instruction can be issued by the operating system of the smartphone. For example, when a ambient light sensor in the smart phone senses that the brightness in the external environment changes, the system sends a corresponding system instruction to the brightness control circuit according to the brightness in the external environment in order to adjust the brightness of the display panel of the smart phone, thereby adapting to the viewing comfort degree of the human eyes. For example, when a user manually adjusts the brightness of the display panel through a touch screen or a brightness button (such as a brightness button on a laptop keyboard), the system sends a corresponding system instruction to the brightness control circuit to adjust the brightness of the display panel.

For example, the brightness adjustment technology of the OLED display panel includes a voltage programming brightness adjustment, a gray-scale conversion brightness adjustment, an area ratio brightness adjustment, or a time ratio brightness adjustment, etc., which can be selected according to requirements. For example, the voltage programming brightening technique is implemented by adjusting a cathode driving voltage. For example, the brightness of the display panel can be increased by increasing the amplitude of the cathode driving voltage. For example, the gray-scale conversion brightness adjustment technique achieves the purpose of increasing the brightness of the display panel by converting an input signal of 8-byte gray-scale and an additional 4-level brightness values into an input signal of 10-byte. For example, the area ratio brightness adjustment technique adjusts the brightness of the display panel by controlling the on/off states of the sub-pixels. For example, the time ratio brightness adjustment technique adjusts the brightness of the display panel by means of the on/off states of the pixels combined with frame rate conversion. For example, the brightness adjustment techniques of the display panel can be used in combination with one another to better realize the adjustment of the brightness of the display panel. For example, by adjusting the brightness of the display panel by the above-described brightness adjustment techniques, the brightness of the display panel can be adjusted within a large range.

For example, the embodiments of the present disclosure may adjust the brightness level of the display panel by Pulse Width Modulation (PWM), which belongs to the time ratio brightness adjustment technology. For example, the duty cycle of the drive voltage can be adjusted to achieve the adjustment of the brightness level.

Figure 8:
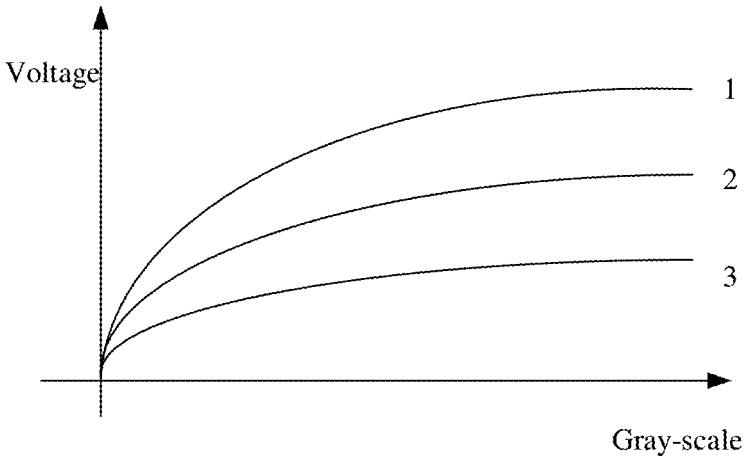
FIG. 8 is a graph showing adjustment curves of different gamma ranges in an optical compensation method according to some embodiments of the present disclosure.

FIG. 8 is a graph showing adjustment curves of different gamma ranges in an optical compensation method according to an embodiment of the present disclosure. For example, when the brightness level of the display panel is not modulated by PWM, the display brightness values (DBVs) of different gamma curves and the offset-scalars corresponding to different current brightness levels are as shown in Table 1, and the offset-scalar c increases as the current brightness level decreases. For example, the different gamma curves as shown in FIG. 8 correspond to different display brightness values. For example, the display brightness value of the gamma curve 1 as shown in FIG. 8 is indicated as FF; the display brightness value of the gamma curve 2 as shown in FIG. 8 is indicated as EA; and the display brightness value of the gamma curve 3 as shown in FIG. 8 is indicated as D5.

TABLE 1

| DBV | FF | EA | D5 |
|---|---|---|---|
| Current brightness level (nit) | 350 | 323.8 | 297.5 |
| Offset-scalar c | 1 | 1.036 | 1.076 |

For example, when PWM is used to modulate the brightness level of the display panel, the display brightness values of different gamma curves and the offset-scalars corresponding to different current brightness levels are as shown in Table 2. The offset-scalar c increases as the current brightness level decreases.

TABLE 2

| DBV | FF | EA | D5 |
|---|---|---|---|
| Current brightness level (nit) | 350 | 323.8 | 297.5 |
| Offset-scalar c | 1 | 1 | 1.076 |

As can be seen from Table 1, when the brightness level of the display panel is not adjusted by using PWM, for example, when DVB=EA, the offset-scalar c is equal to 1.036; it can be seen from Table 2 that when the brightness level of the display panel is adjusted by using PWM, for example, when DVB=EA, the value of offset-scalar c remains unchanged, still equal to 1. Therefore, when PWM is used, the offset-scalars have the same value for both FF and EA gamma curves. At the same time, it can be seen from Table 1 and Table 2 that as the current brightness level decreases, the value of the offset-scalar increases, which solves the problem that the change amplitude of the Mura becomes larger and larger as the brightness level becomes lower.

Step S1322: acquiring a brightness level, which the display panel is currently instructed to present, as the current brightness level.

For example, after receiving the system instruction, the brightness control circuit generates a brightness control signal, which is used to control the brightness level of the display panel to change; at the same time, the brightness level included in the system instruction is used as the current brightness level for acquiring the offset-scalar corresponding to the brightness level, and step S1323 is performed based on the current brightness level.

Step S1323: adjusting the pre-stored compensation parameter based on the current brightness level to obtain an adjusted compensation parameter.

This step S1323 is similar to step S130, and details are not described herein again.

Step S1324: not performing adjustment.

After that, the brightness control signal of the brightness control circuit and the compensated display data signal are simultaneously used for the display panel to perform a display operation, and the brightness of the display picture is compatible with the compensation.

For another example, during the time period when the current brightness level of the display panel does not change, that is to say, when the change amplitude of the Mura does not change, the image can be compensated well without adjusting the compensation parameter.

It should be noted that in at least one embodiment of the present disclosure, the display panel involved may include a plurality of display areas, and the display panel is for example a display panel employed by VR display glasses. In an optical compensation method according to at least one embodiment of the present disclosure, correspondingly, the pre-stored compensation parameter(s), the current brightness level, and the adjustment compensation parameter correspond to at least one display area, and the display data signal of the at least one display area is compensated based on the adjusted compensation parameter(s). For example, adjusted compensation parameters of the plurality of display areas are respectively obtained, and display data signals of the plurality of display areas are respectively compensated.

For example, the display brightness level of each display area may be different, for example, the brightness level of the partial display area at which the user is gazing is higher than the brightness level of the partial display area at which the user is not gazing. Therefore, on account of the difference in brightness level of each display area, the calculation of the pre-stored compensation parameter, the offset-scalar, and the adjusted compensation parameter for each display area may be performed separately, and the display data of each display area is separately compensated based on the adjusted compensation parameter(s) of each display area.

It should be noted that, in the embodiments of the present disclosure, the flow of the optical compensation method for an organic light emitting diode display panel may include more or less operations, which may be performed sequentially or in parallel. Although the flow of the compensation method described above includes a plurality of operations occurring in a specific order, it should be clearly understood that the order of the plurality of operations is not limited. The image processing method described above may be performed once or may be performed a plurality of times according to predetermined conditions.

Some embodiments of the present disclosure further provide a display method for a display panel, the display method includes: compensating the display data signal of the display panel by using an optical compensation method provided by any embodiment of the present disclosure; performing a display operation using the compensated display data signal. For example, the compensated display data is the compensated pixel voltage Y obtained in step S140.

Figure 9:
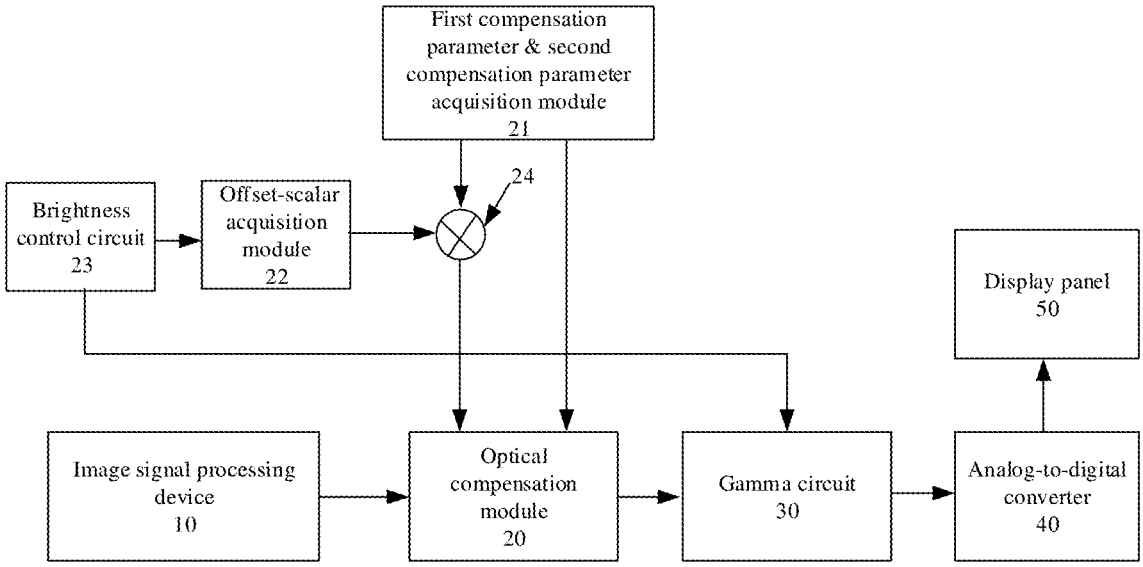
FIG. 9 is a schematic block diagram of a display system for a display panel according to some embodiments of the present disclosure.

FIG. 9 is a schematic block diagram of a display system of an organic light emitting diode display panel according to an embodiment of the present disclosure. Referring to FIG. 9, the display system of an embodiment of the present disclosure includes an image signal processing device 10, an optical compensation module 20, a gamma circuit 30, an analog-to-digital converter 40, and a display panel 50. For example, the optical compensation module 20 is coupled to the first compensation parameter & second compensation parameter acquisition module 21, the offset-scalar acquisition module 22, and the brightness control circuit 23. For example, these modules can be implemented by hardware (for example, circuit) modules, firmware modules, or software modules, and the like.

The image signal processing device 10 can receive an image signal received by the display panel from the image source and decode the image signal to obtain a display data signal, and transmit the display data signal to the optical compensation module 20. The image signal is for example received by the display panel via an antenna, data interfaces (USB interface or HDMI interface) of various types or a network interface, and then obtained, for example, by demodulation by means of a modem. For example, the decoded display data signal may be a gray-scale data signal including an initial pixel voltage X before compensation.

The optical compensation module 20 can be used to implement the optical compensation method provided by any of the embodiments of the present disclosure. For example, the optical compensation module 20 performs data processing on the received display data signal to obtain a compensated display data signal, and the data processing uses the first compensation parameter a, the second compensation parameter b1, and the offset-scalar c to perform the above polynomial calculation. For example, when calculating or acquiring the offset-scalar c, it is also necessary to consider the current brightness level of the display panel under the control of the brightness control circuit 23. For example, the first compensation parameter a and the second compensation parameter b1 may be obtained from a storage device (not shown) by the first compensation parameter & second compensation parameter acquisition module 21, and the offset-scalar c may be obtained from the same or another storage device (not shown) by the offset-scalar acquisition module 22. For example, before compensating the display data signal in the optical compensation module 20, the second compensation parameter b1 and the offset-scalar c are multiplied (or added, subtracted, etc.) by an arithmetic unit (an arithmetic circuit) 24 to obtain an adjusted compensation parameter b2, the optical compensation module 20 then calculates the display data signal from the image signal processing device 10 based on the first compensation parameter a and the adjusted compensation parameter b2 in order to obtain a compensated display data signal. For example, the operation can be implemented by a multiplier (or an adder-subtractor) or software.

For example, in step S140, the optical compensation module 20 compensates the received display data signal to obtain the compensated pixel voltage Y (i.e., the compensated display data signal). For example, the compensated pixel voltage is then transmitted to the gamma circuit 30.

The gamma circuit 30, in connection with the brightness control signal of the brightness control circuit 23, adjusts the received compensated pixel voltage, thereby correcting the compensated display data signal (the compensated pixel voltage) based on a predetermined gamma curve, that is to say, performs a gamma correction. For example, the gamma corrected display data signal is input to the analog-to-digital converter 40.

For example, the analog-to-digital converter 40 converts the corrected display data signal into an analog signal, and outputs the analog signal to the data drive circuit under the control of the timing controller. The data drive circuit inputs the analog signal into a pixel circuit (such as the pixel circuit as shown in FIG. 1) of a pixel unit arranged in a array in the display panel 50 through a data line, thereby realizing corresponding gray-scale and realizing corresponding brightness display.

It should be noted that the pixel circuit in the embodiment of the present disclosure is not limited to the pixel circuit as shown in FIG. 1, and may be any pixel circuit of other structures, such as a 4T2C pixel circuit or the like, and may include a compensation sub-circuit, reset sub-circuit, lighting control sub-circuit, etc.

It should be noted that, in order to be clear and concise, the embodiments of the present disclosure do not give all the constituent units of the display system for realizing the OLED display method. In order to realize the organic light-emitting diode display method, those skilled in the art can provide and set other constituent units not shown according to specific needs, and the embodiment of the present disclosure are not limited in this aspect. It should be noted that each of the above modules may be implemented by software, firmware, hardware (for example, an FPGA), or any combination thereof.

Regarding the technical effects of the display method of the organic light emitting diode display panel, reference may be made to the technical effects of the optical compensation method provided in the embodiments of the present disclosure, and details are not described herein again.

Figure 10:
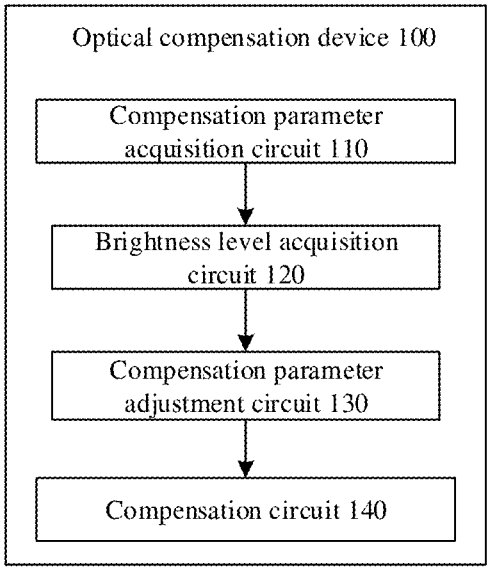
FIG. 10 is a schematic block diagram of an optical compensation device for a display panel according to some embodiments of the present disclosure.

FIG. 10 is a schematic block diagram of an optical compensation device for an organic light emitting diode display panel according to an embodiment of the present disclosure. As shown in FIG. 10, the optical compensation device 100 includes a compensation parameter acquisition circuit 110, a brightness level acquisition circuit 120, a compensation parameter adjustment circuit 130, and a compensation circuit 140.

The compensation parameter acquisition circuit 110 is configured to acquire a pre-stored compensation parameter of the display panel. For example, the compensation parameter acquisition circuit 110 may implement step S110, and may include, for example, the first compensation parameter & second compensation parameter acquisition module 21 as shown in FIG. 9.

The brightness level acquisition circuit 120 is configured to acquire a current brightness level of the display panel. For example, the brightness level acquisition circuit 120 can implement step S120, and can include, for example, the brightness control circuit 23 as shown in FIG. 9.

The compensation parameter adjustment circuit 130 is configured to adjust the pre-stored compensation parameter based on the current brightness level to obtain an adjusted compensation parameter. For example, the compensation parameter adjustment circuit 130 may implement step S130, and may include, for example, the arithmetic unit 24 that performs the calculation with the offset scalar c and the second compensation parameter b1 and the offset-scalar acquisition module 22 as shown in FIG. 9.

The compensation circuit 140 is configured to compensate the display data signal of the display panel based on the adjusted compensation parameter. For example, the compensation circuit 140 can implement step S140, which can include, for example, the optical compensation module 20 as shown in FIG. 9.

It should be noted that in the embodiments of the present disclosure, more or less circuits may be included, and the connection relationship between the respective circuits is not limited in this aspect, and may be determined according to actual needs. The specific configuration of each circuit is not limited in this aspect, and may be provided by an analog device according to the circuit principle, or may be a digital chip, or in other suitable manner.

Figure 11:
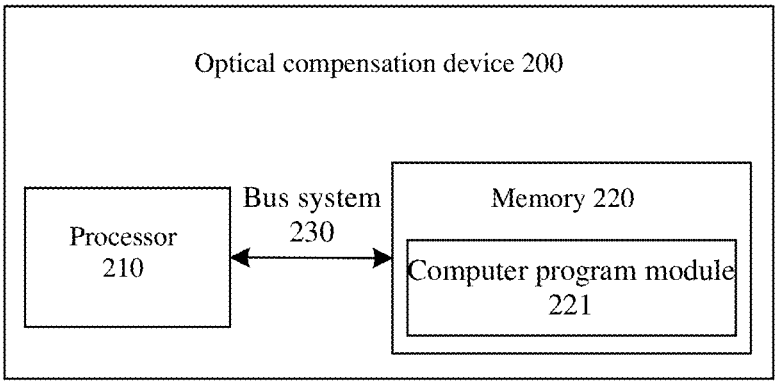
FIG. 11 is a schematic block diagram of an optical compensation device for another display panel according to some embodiments of the present disclosure.

FIG. 11 is a schematic block diagram of an optical compensation device of another organic light emitting diode display panel according to an embodiment of the present disclosure. As shown in FIG. 11, the optical compensation device 200 includes a processor 210, a memory 220, and one or more computer program modules 221.

For example, the processor 210 and the memory 220 are connected by a bus system 230. For example, the one or more computer program modules 221 is stored in memory 220. For example, the one or more computer program modules 221 can include instructions for performing an optical compensation method for an organic light emitting diode display panel provided by any of the embodiments of the present disclosure. For example, instructions in the one or more computer program modules 221 can be executed by the processor 210. For example, the bus system 230 can be a conventional serial communication bus, a parallel communication bus, etc., and embodiments of the present disclosure are not limited in this aspect.

For example, the processor 210 can be a central processing unit (CPU) or processing unit of other forms with data processing capabilities and/or instruction execution capabilities, the processor 210 can be a general purpose processor or a dedicated processor, and can control other components in the optical compensation device 200 to perform the desired functions. The memory 220 can include one or more computer program products, which can include various forms of computer readable storage media, such as volatile memory and/or nonvolatile memory. The volatile memory may include, for example, random access memory (RAM) and/or cache or the like. The nonvolatile memory may include, for example, a read only memory (ROM), a hard disk, a flash memory, or the like. One or more computer program instructions can be stored on a computer readable storage medium, and the processor 210 can execute the program instructions to implement the functions (implemented by the processor 210) in the disclosed embodiments and/or other desired functions, for example, an optical compensation method or the like. Various applications and various data may also be stored in the computer readable storage medium, such as preset threshold brightness and various data used and/or generated by the applications.

It should be noted that, in order to be clear and concise, the embodiments of the present disclosure do not give all the constituent units of the optical compensation device 200. In order to realize the necessary functions of the optical compensation device 200, those skilled in the art can provide and set other constituent units not shown according to specific needs, and the embodiments of the present disclosure is not limited to this case.

Regarding the technical effects of the optical compensation device 100 and the optical compensation device 200 in the different embodiments, reference may be made to the technical effects of the optical compensation method provided in the embodiments of the present disclosure, and details are not described herein again.

Figure 12:
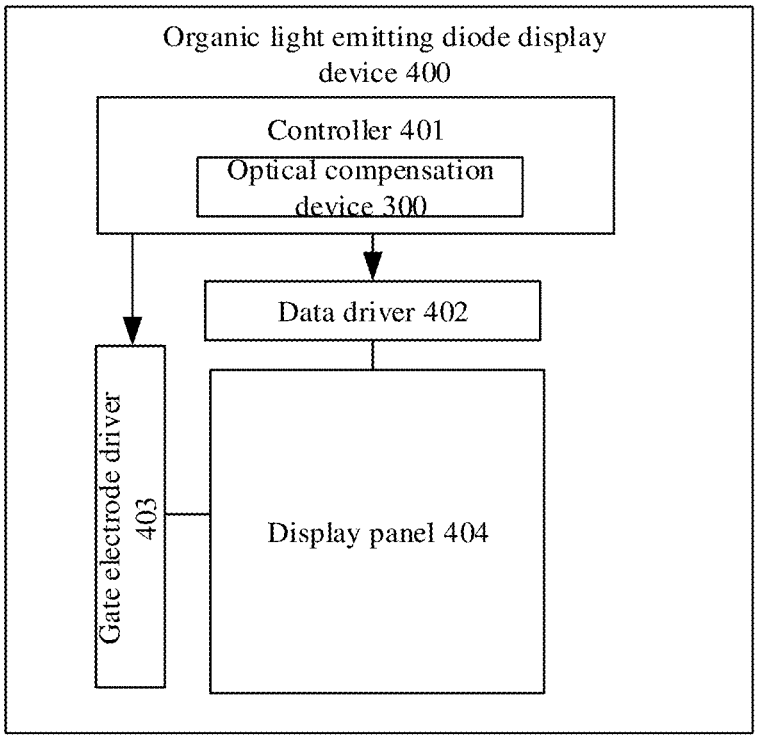
FIG. 12 is a schematic block diagram of a display device according to some embodiments of the present disclosure.

At least one embodiment of the present disclosure further provides a display device, such as an organic light emitting diode display device, including an optical compensation device of an organic light emitting diode display panel provided by any of the embodiments of the present disclosure. FIG. 12 is a schematic block diagram of an organic light emitting diode display device according to an embodiment of the present disclosure. As shown in FIG. 12, an organic light emitting diode display device 400 includes an optical compensation device 300. For example, the optical compensation device 300 can be the optical compensation device 100 as shown in FIG. 10 or the optical compensation device 200 as shown in FIG. 11.

As shown in FIG. 12, the OLED display device may further include a controller 401 (for example, a timing controller T-con), a data driver 402, a gate driver 403, and a display panel 404. For example, the optical compensation device 300 is disposed in the controller 401, and outputs the compensated display data signal to the data driver 402 under the control of the controller 401.

For example, the display panel 404 is used to display an image. After the image data to be displayed is input to the OLED display device 400, the input display data signal is compensated by the optical compensation device 300, and then the display panel 404 displays the compensated image data, thereby improving the display effect of the display panel, promoting the display quality, and improving the display uniformity. For example, the display panel 404 can be an organic light emitting diode display panel.

For example, the display panel 404 includes a plurality of array-arranged sub-pixels, as shown in FIG. 1, each of the sub-pixels including a drive circuit and a light-emitting element OLED. The drive circuit includes at least a driving transistor N0 and a switching transistor T0.

For example, the gate driver 403 is configured to be connected to the switching transistors T0 through a plurality of gate lines for supplying gate scan signals to the switching transistors T0, thereby controlling the on/off states of the switching transistors T0.

For example, the data driver 402 is configured to receive an output of the optical compensation device 300 in the controller 401 and then provide an image data signal to the display panel 404. The image data signal is, for example, a compensated pixel voltage for controlling the relative lightness intensity of the light-emitting element OLED of the corresponding sub-pixel in display to present a certain gray-scale. The higher the voltage of the image data signal, the larger the gray-scale, thereby making the relative lightness intensity of the light-emitting element OLED larger. Moreover, under different display brightness, the absolute brightness of the sub-pixel is different even at the same gray scale. For example, depending on the combination of different functional modules, the data driver 402 can include a digital driver and an analog driver. The analog driver receives the red, green and blue (RGB) analog signals, and then outputs the RGB analog signals to the sub-pixels via the thin film transistors; the digital driver receives the RGB digital signals, which is subjected to D/A (digital/analog) conversion and gamma correction inside the data driver, and converted into analog signals and output to the sub-pixels via the thin film transistors.

For example, the data driver 402 and the gate driver 403 may be implemented by ASIC chips, respectively, or may be directly fabricated on the display panel 404 by a semiconductor fabrication process.

Some embodiments of the present disclosure also provide a storage medium. For example, the storage medium non-transitory storing computer readable instructions. The optical compensation method of the organic light emitting diode display panel provided by any of the embodiments of the present disclosure may be performed when the non-transitory computer readable instructions are executed by a computer (including a processor).

For example, the storage medium may be any combination of one or more computer readable storage media, such as one computer readable storage medium including computer readable program codes for an optical compensation method, and another computer readable storage medium including computer readable program codes for determining a current brightness level. For example, when the program codes are read by a computer, the computer can execute the program codes stored in the computer storage medium, perform a method that provided by any of the embodiments of the present disclosure, such as an optical compensation method, an operation method of determining a current brightness level, and the like.

For example, the storage medium may include a memory card of a smart phone, a storage unit of a tablet computer, a hard disk of a personal computer, a random access memory (RAM), a read only memory (ROM), an erasable programmable read only memory (EPROM), a portable compact disk read only memory (CD-ROM), a flash memory, or any combination of the above storage media, and the storage medium can also be other suitable storage media.

The following points need to be explained:

(1) The drawings of the present disclosure relate only to the structure related to the embodiments of the present disclosure, and other structures may refer to a general design.

(2) In the case of no conflict, the features of the embodiments and the embodiments of the present disclosure may be combined with each other to obtain a new embodiment.

The above description is only an exemplary embodiment of the present invention, and is not intended to limit the scope of the present invention. The scope of the present invention is defined by the appended claims.

What is claimed is:

1. An optical compensation method for a display panel, comprising:

obtaining a pre-stored compensation parameter of the display panel;

obtaining a current brightness level of the display panel;

adjusting the pre-stored compensation parameter based on the current brightness level to obtain an adjusted compensation parameter; and compensating a display data signal of the display panel based on the adjusted compensation parameter, wherein a calculation formula for compensating the display data signal of the display panel based on the adjusted compensation parameter is expressed as:

$$Y=aX+b2,$$

where Y represents a compensated pixel voltage, X represents an initial pixel voltage of the display panel, a represents a first optical compensation parameter, and b2 represents an adjusted compensation parameter and is determined based on the current brightness level of the display panel, wherein the adjusted compensation parameter is expressed as:

$$b2=b1*c$$

where b1 represents a second optical compensation parameter, c represents an offset-scalar and is determined based on the current brightness level of the display panel.

2. The optical compensation method according to claim 1, wherein an adjustment amplitude for adjusting the pre-stored compensation parameter decreases as the current brightness level increases.

3. The optical compensation method according to claim 2, further comprising:

determining whether the current brightness level of the display panel is lower than a threshold brightness;

adjusting the pre-stored compensation parameter based on the current brightness level in a case where the current brightness level of the display panel is lower than the threshold brightness; and in the case where the current brightness level of the display panel is not lower than the threshold brightness, not adjusting.

4. The optical compensation method according to claim 2, wherein the display panel comprises a plurality of display areas, the pre-stored compensation parameter, the current brightness level, and the adjusted compensation parameter correspond to at least one display area, and the display data signal of the at least one display area is compensated based on the adjusted compensation parameter.

5. The optical compensation method according to claim 4, further comprising:

obtaining an adjusted compensation parameter of each of the plurality of display areas respectively; and compensating the display data signal of each of the plurality of display areas respectively.

6. The optical compensation method according to claim 2, further comprising:

determining whether the brightness of the display panel has been instructed to change;

acquiring a brightness level, which the display panel is currently instructed to present, as the current brightness level in a case where the brightness of the display panel has been instructed to change; and adjusting the pre-stored compensation parameter based on the current brightness level to obtain the adjusted compensation parameter.

7. The optical compensation method according to claim 1, wherein predetermined offset-scalars corresponding to different brightness levels of the display panel are stored in a lookup table correspondingly with the different brightness levels of the display panel, and the optical compensation method further comprises:

obtaining, from the lookup table, the offset-scalar corresponding to the current brightness level.

8. The optical compensation method according to claim 1, wherein a range of variation of the offset-scalar varies between 0.5 times and 5 times.

9. The optical compensation method according to claim 1, further comprising:

determining whether the current brightness level of the display panel is lower than a threshold brightness;

adjusting the pre-stored compensation parameter based on the current brightness level in a case where the current brightness level of the display panel is lower than the threshold brightness; and in the case where the current brightness level of the display panel is not lower than the threshold brightness, not adjusting.

10. The optical compensation method according to claim 1, wherein the display panel comprises a plurality of display areas, the pre-stored compensation parameter, the current brightness level, and the adjusted compensation parameter correspond to at least one display area, and the display data signal of the at least one display area is compensated based on the adjusted compensation parameter.

11. The optical compensation method according to claim 10, further comprising:

obtaining an adjusted compensation parameter of each of the plurality of display areas respectively; and compensating the display data signal of each of the plurality of display areas respectively.

12. The optical compensation method according to claim 1, further comprising:

determining whether the brightness of the display panel has been instructed to change;

acquiring a brightness level, which the display panel is currently instructed to present, as the current brightness level in a case where the brightness of the display panel has been instructed to change; and adjusting the pre-stored compensation parameter based on the current brightness level to obtain the adjusted compensation parameter.

13. A display method for a display panel, comprising:

compensating the display data signal of the display panel by using the optical compensation method according to claim 1; and performing a display operation using the compensated display data signal.

14. An optical compensation device for a display panel, comprising:

a processor;

a memory, non-transitorily storing at least one computer program module, wherein the at least one computer program module is configured to be executed by the processor, the at least one computer program module comprising instructions for performing the optical compensation method for a display panel of claim 1.

15. A storage medium, non transitorily storing computer readable instructions, wherein the non-transitory computer readable instructions, when executed by a computer, implement an optical compensation method for a display panel according to claim 1.

16. An optical compensation device for a display panel, comprising:

a compensation parameter acquisition circuit, which is configured to acquire a pre-stored compensation parameter of the display panel;

a brightness level acquisition circuit, which is configured to acquire a current brightness level of the display panel;

a compensation parameter adjustment circuit, which is configured to adjust the pre-stored compensation parameter based on the current brightness level to obtain an adjusted compensation parameter; and a compensation circuit, which is configured to compensate the display data signal of the display panel based on the adjusted compensation parameter, wherein a calculation formula for compensating the display data signal of the display panel based on the adjusted compensation parameter is expressed as:

$$Y=aX+b2,$$

where Y represents a compensated pixel voltage, X represents an initial pixel voltage of the display panel, a represents a first optical compensation parameter, and b2 represents an adjusted compensation parameter and is determined based on the current brightness level of the display panel, wherein the adjusted compensation parameter is expressed as:

$$b2=b1*c$$

where b1 represents a second optical compensation parameter, c represents an offset-scalar and is determined based on the current brightness level of the display panel.

17. A display device, comprising the optical compensation device for the display panel of claim 16.

* * * * *